United States Patent [19]

Bouchet

[11] 4,133,447

[45] Jan. 9, 1979

[54] INVIOLABLE CLOSING DEVICE FOR CONTAINERS

[75] Inventor: Bernard Bouchet, Oyonnax, France

[73] Assignee: Etablissements Leon Goiffon, Oyonnax, France

[21] Appl. No.: 850,092

[22] Filed: Nov. 8, 1977

[30] Foreign Application Priority Data

Nov. 9, 1976 [FR] France ..... 76 34385

[51] Int. Cl.[2] ..... B65D 51/22

[52] U.S. Cl. ..... 220/258; 220/306

[58] Field of Search ..... 220/258, 306; 229/43 R

[56] References Cited

U.S. PATENT DOCUMENTS

| | | | |
|---|---|---|---|
| 3,904,074 | 9/1975 | Hoffman et al. | 220/258 X |
| 4,044,941 | 8/1977 | Knudsen | 229/43 |

*Primary Examiner*—George T. Hall

*Attorney, Agent, or Firm*—Browdy & Neimark

[57] ABSTRACT

An inviolable closing device for a container comprises a tightly fitting collar having a plastic film which collar fits tightly over the neck of the container and cannot be removed without the destruction thereof. Over the collar with its integral film is placed a cap which may mate with the neck of the container in a conventional manner.

7 Claims, 3 Drawing Figures

INVIOLABLE CLOSING DEVICE FOR CONTAINERS

The object of the present invention is an inviolable closing device for containers.

The majority of containers, whatever the nature of the products which they contain, are generally fitted with an inviolable closing device preventing any removal or any substitution of the conditioned product between the time of the conditioning and the time of the first use by the consumer.

Very frequently, the inviolable closing devices are directly connected to the stopper of the container which is held either by an adhesive tape or by a strip of a synthetic substance which must be torn to allow the stopper to be removed. Yet the latter solution referred to is not very sightly and does not allow the container to be completely sealed after its first use.

There also exist closing devices comprising within the neck of the container a throat liner which is itself sealed by a cap made of a synthetic substance.

This solution is relatively costly to be implemented, leads to a rather mediocre presentation and cannot therefore be suitable for containers which contain products of any kind.

The object of the present invention is to remedy these drawbacks by providing an inviolable closing device which is efficient, simple in operation and does not affect the general sightliness of the container which it equips.

For this purpose, the device comprises:

A hollow stopper or cap, that is to say, comprising a cylindrical skirt sealed at one of its boundaries by an end capable of being engaged on the container neck and capable of being retained thereon in the conventional way.

A collar made of a synthetic substance with a diameter which is smaller than that of the stopper or cap, one end of which is closed by a film of a synthetic substance deformable or not, and having near its other end, a rim projecting towards the inside.

A container neck having from the container towards its free end, a zone allowing support for a part of the skirt of the stopper and a groove for engaging the rim of the collar, without any possibility of withdrawing the latter, situated at such a distance from the end of the neck that the integral film of the collar should rest against it when the rim is engaged in the groove.

Before the first use, the container fitted with this closing device appears like a conventional container, only the hollow stopper being visible. When the stopper is taken out it will be found that the collar of the synthetic substance is irreversibly fixed to the container neck, the film for its part adhering to the end of the neck and corresponding to its relief, which ensures both the integrity and additionally the tightness of the closure.

To prevent any accidental or deliberate withdrawal of the collar, the groove arranged within the container neck is bounded on the side of the free end of the latter, by a plane surface parallel to the plane of the neck opening, and the part of the rim turned towards the film presents a junction zone with the collar which is plane and parallel to the film.

Conveniently, the part of the container neck bounding the groove presents at the side of the free end of the neck, a zone sloping from the inside towards the outside and from the free end of the neck towards the container body, while the part of the rim of the collar situated on the open side of the latter presents a zone sloping from the outside towards the inside and from the open end of the collar towards the film possessed by the latter. This facilitates the positioning of the collar with a view to the sealing of the neck by the film of the synthetic substance.

Moreover, it should be noted that the positioning of the collar and of the stopper may be effected simultaneously by previously mounting the collar in the stopper and then fitting the stopper on the container neck simply by pressing it.

To open the container, first of all the stopper must be taken out which may either be fixed to the neck simply by friction, or be fixed to the neck by other means such as an elastic fit. To have access to the product, it is then necessary either to tear the film or to destroy the collar. For this purpose, the latter may be fitted with weak zones entailing its destruction in the case of opening by means of this collar. Moreover, the access to the collar may be protected by a wall with a vertical or sloping overhang barring direct access to the lower part of the collar.

In any case, the invention will be duly understood with the help of the following description with reference to the attached schematic drawing representing an embodiment of this device as a non-restrictive example:

Figure 1:
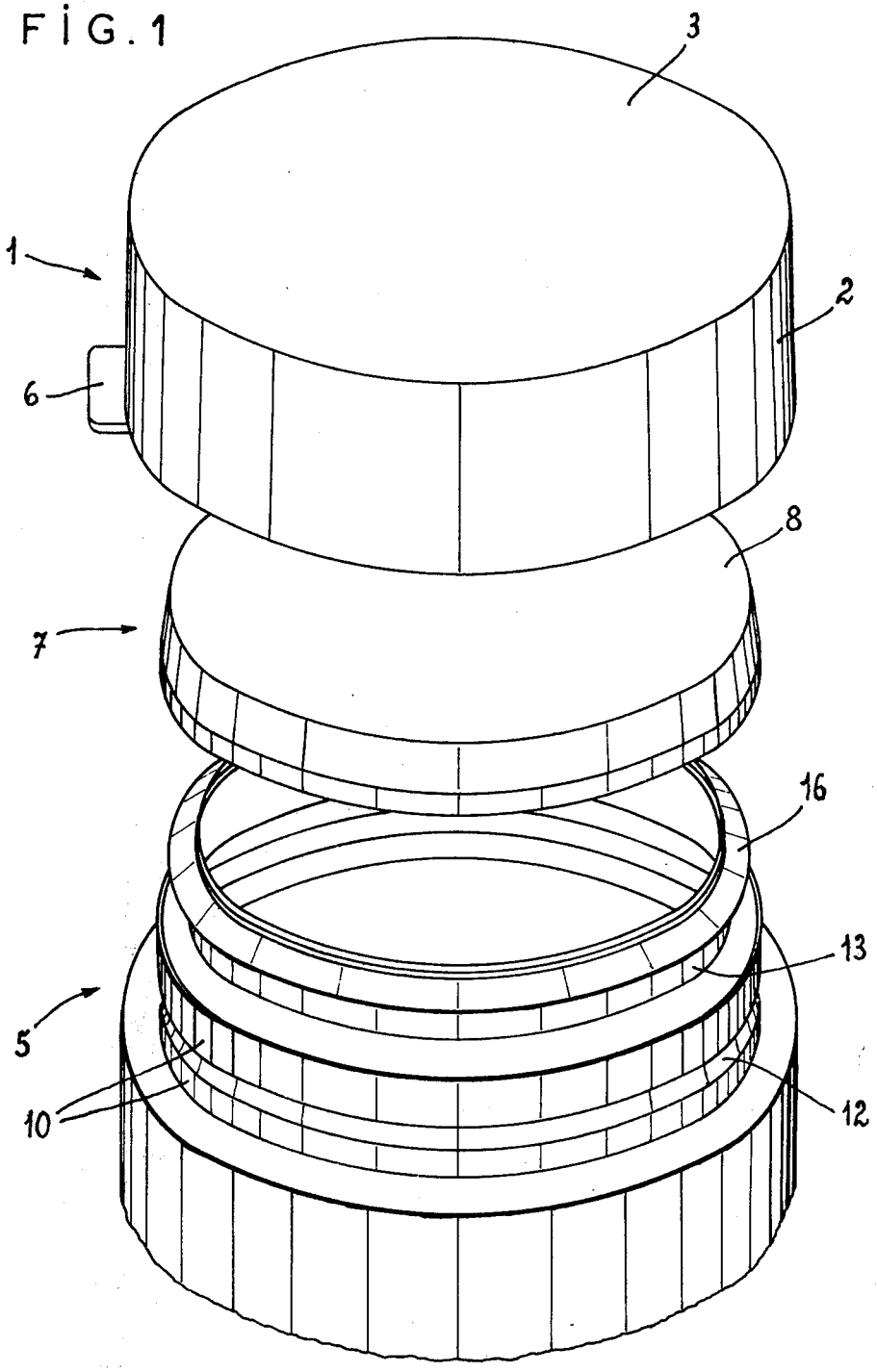
FIG. 1 shows an exploded view of the different elements constituting the device.
Figure 2:
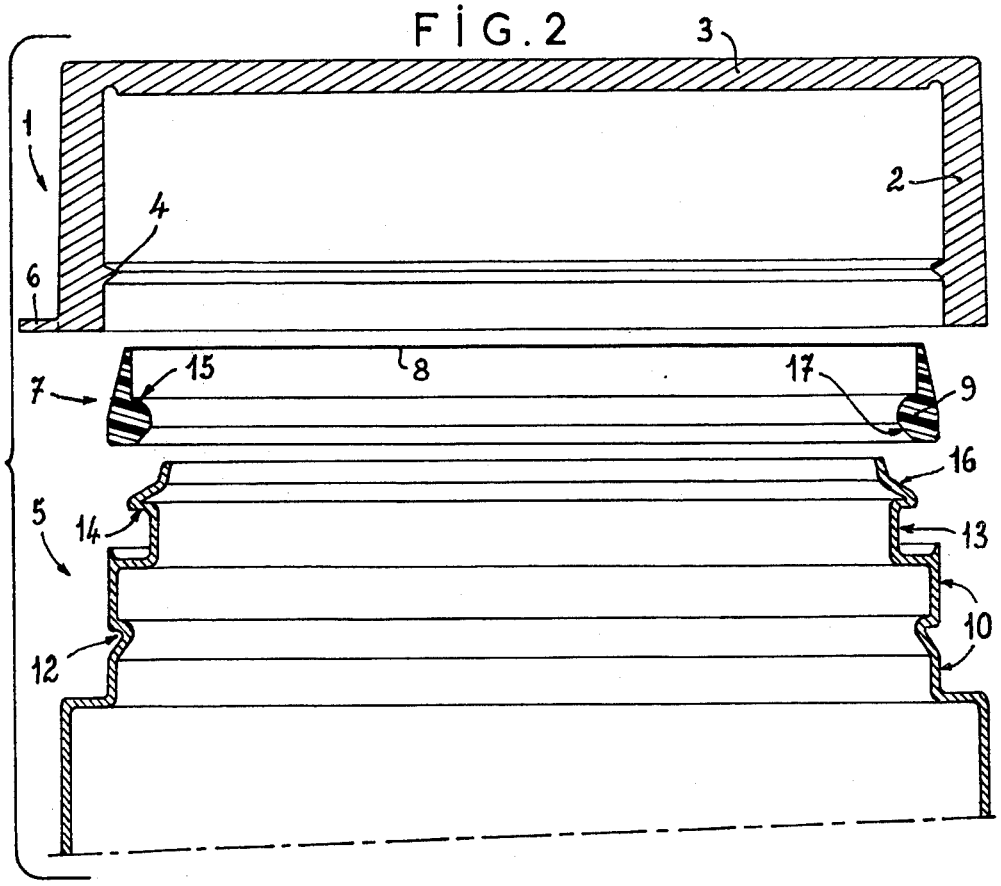
FIGS. 2 and 3 are views of longitudinal sections before and after assembly of the constituent elements respectively.
Figure 3:
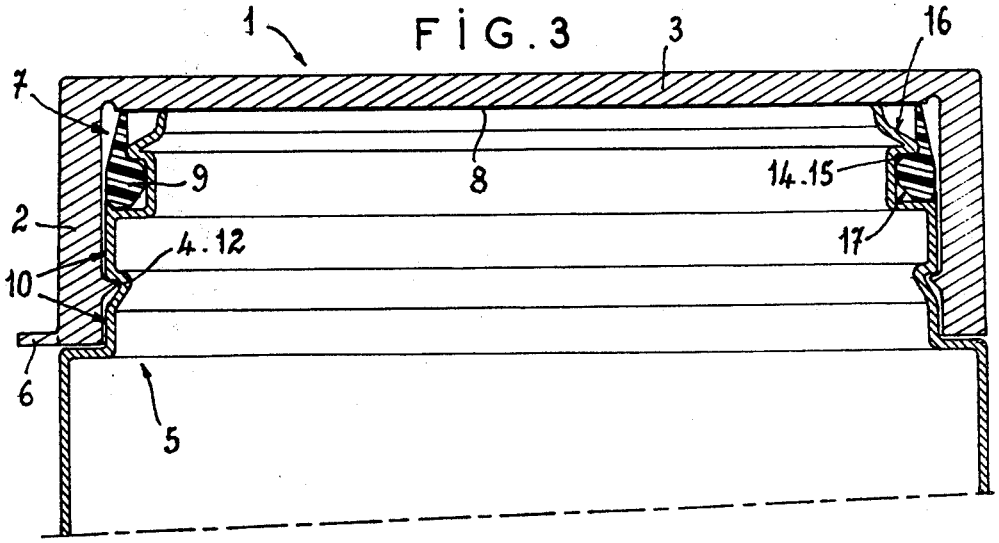

The device shown in the drawing comprises a hollow stopper or resilient 1 made of a flexible synthetic material, constituted by a cylindrical skirt 2 closed at one of its boundaries by end 3. This stopper, intended to be engaged on neck 5 of a container comprises, on its internal side, a rim 4 which is intended to be engaged in a groove arranged in the neck to ensure the integration of these two elements. It comprises, moreover, a tab 6 allowing it to be removed from the neck with a view to opening the container.

This device comprises a second element constituted by a collar 7 made of a flexible and elastic synthetic material such as a polyethylene. One of the ends of collar 7 is closed by a film 8 made of a shrinkable or stretchable synthetic material welded to the edge of the collar. This collar 7 has near its other end a rim 9 projecting towards the inside. This rim is intended to be engaged in a peripheral groove arranged on neck 5 of the container to be closed.

This device comprises a third element constituted by neck 5 its free end, a zone 10 intended to support a part of stopper 1, a groove 12 intended to be penetrated by the rim 4 of the stopper with a view to securing the latter, a groove 13 intended to be engaged by the rim 9 of collar 7, situated at such a distance from the neck end that film 8 should rest against it when rim 9 is engaged in groove 13.

To prevent any accidental or deliberate withdrawal of collar 7 without destroying it, groove 13 is bounded on the side of the free collar end by a flat surface 14 parallel to the plane of the neck opening, whilst the part of rim 9 turned towards film 8 has a jointing zone 15 with the collar which is plane and parallel to film 8.

To facilitate the positioning of collar 7, the part of container neck 5 bounding the throat and situated on the free end of the neck, has a lip zone 16 sloping from the inside towards the outside and from the free end of the neck, towards the body of the container, while the part of rim 9 of collar 7 situated on the open side of the latter, has a surface 17 sloping from the outside towards the inside and from the open end of the latter towards film 8. In this way, the fitting of collar 7 may be effected simultaneously with the positioning of the stopper.

As goes without saying, the invention is not limited to the single embodiment of this device described above by way of example; on the contrary, it encompasses all alternative embodiments.

I claim:

1. An inviolable closing device for a container, comprising:

a hollow cap having a cylindrical skirt and closed at its upper end by a wall, said cap being capable of being engaged on the neck of the container and capable of being retained thereon in the conventional way, a collar made of a synthetic material with a smaller diameter than that of said cap, one end of said collar being closed by a film made of a synthetic material and integral therewith, and having near its other end a rim projecting towards the inside, a container neck having, from the container towards its free end, a zone for supporting a part of the skirt of said cap and a groove for engaging the inwardly projecting rim of the collar, said collar being engagable with the groove of said neck without any possibility of removal of the collar without its destruction, said groove being located at such a distance from the end of the neck that the integral film rests against the free end of the container neck when the rim is engaged in the groove;

whereby, when initially closed, said hollow cap covers said collar over the neck of the container.

2. Device according to claim 1, said groove in the container neck is bounded on the side of the free end of the neck by a plane surface parallel to the plane of the opening of the neck, and the part of the rim turned towards the side of the film has a jointing zone with the collar which is plane and parallel to the film.

3. Device according to claim 1 wherein the neck of the container at the free end thereof has a zone sloping from the inside towards the outside and from the free end of the neck towards the body of the container, while the part of the rim of the collar situated on the open side of the latter has a zone sloping from the outside towards the inside and from the open end of the collar, towards the integral film.

4. Device according to claim 1, characterised in that the film closing the collar is welded thereto.

5. Device according to claim 2 wherein the neck of the container at the free end thereof has a zone sloping from the inside towards the outside and from the free end of the neck towards the body of the container, while the part of the rim of the collar situated on the open side of the latter has a zone sloping from the outside towards the inside and from the open end of the collar, towards the integral film.

6. Device according to claim 5, characterized in that the film closing the collar is welded thereto.

7. A closed and sealed container, comprising:

a container body terminating in a container neck having a free, open end, said container neck having an annular groove adjacent the free open end thereof with a lip located between the free open end and said groove whereby said lip defines said groove; and means on said neck spaced from said groove to engage a cap;

a deformable collar formed of synthetic material and fitting tightly within said groove of said container neck, said collar having an upper wall formed of synthetic plastic film lying over and closing the free open end of said container neck, whereby said collar cannot be removed from said neck without destruction of said collar;

a hollow cap having a cylindrical skirt and closed at its upper end by a top wall, said cap engaging the neck of said container at said cap engaging means, and overlying said collar.

* * * * *